US006278085B1

(12) United States Patent
Abukasm

(10) Patent No.: US 6,278,085 B1
(45) Date of Patent: Aug. 21, 2001

(54) MODULAR SNOW MELTING CARPET DEVICE

(76) Inventor: Ziad Georges Abukasm, 591, avenue Kindersley, Mont-Royal (CA), H3R 1S3

( * ) Notice: Subject to any disclaimer, the term of this patent is extended or adjusted under 35 U.S.C. 154(b) by 0 days.

(21) Appl. No.: 09/492,123

(22) Filed: Jan. 27, 2000

(51) Int. Cl.[7] ..... H05B 1/00

(52) U.S. Cl. ..... 219/213; 219/528; 219/544; 219/549

(58) Field of Search ..... 219/211, 212, 219/213, 528, 539, 541, 544, 548, 549; 392/432, 435

(56) References Cited

U.S. PATENT DOCUMENTS

| | | | | |
|---|---|---|---|---|
| 2,844,696 | * | 7/1958 | Custer, Jr. | 219/213 |
| 3,236,991 | * | 2/1966 | Graham et al. | 219/213 |
| 3,260,835 | * | 7/1966 | Soukey et al. | 219/213 |
| 3,540,655 | * | 11/1970 | Hinrichs | 219/213 |
| 3,686,472 | * | 8/1972 | Harris | 219/213 |
| 3,806,702 | | 4/1974 | Spencer . | |
| 3,818,892 | | 6/1974 | Von Kohorn . | |
| 4,284,451 | * | 8/1981 | Conley | 219/528 |
| 4,564,745 | | 1/1986 | Deschenes . | |
| 4,646,818 | | 3/1987 | Ervin . | |
| 4,814,580 | | 3/1989 | Carageorge . | |
| 4,967,057 | * | 10/1990 | Bayless et al. | 219/213 |
| 5,003,157 | * | 3/1991 | Hargrove | 219/213 |
| 5,291,000 | * | 3/1994 | Hornberger | 219/539 |
| 5,380,988 | * | 1/1995 | Dyer | 219/548 |
| 5,387,778 | * | 2/1995 | Stanger | 219/213 |
| 5,550,350 | * | 8/1996 | Barnes | 219/213 |
| 5,591,365 | | 1/1997 | Shields . | |
| 5,966,502 | | 10/1999 | Pearce . | |
| 6,051,812 | * | 4/2000 | Walker | 219/213 |
| 6,092,587 | * | 7/2000 | Ingram | 219/544 |
| 6,107,611 | * | 8/2000 | Jones | 219/549 |

* cited by examiner

*Primary Examiner*—Teresa Walberg
*Assistant Examiner*—Fadi H. Dahbour

(57) ABSTRACT

This modular snow melting carpet device for melting snow and ice on pathways comprises a flat sheet of generally rectangular shape, two conducting wires embedded in the sheet and running along the length of the sheet and generally close to their respective length edge. The conducting wires are connected at both of their extremities to a female single pin connector also embedded into the sheet and exposed at the width edges. The device also comprises a plurality of heating elements also embedded into the sheet and parallel connected along said conducting wires and, two male single pin connectors adapted to mate with the female connectors of one edge and connected to a power source. Additionally, an intersection device may comprise two crossover connecting wires embedded into the sheet and electrically insulated from the conducting wires and heating elements. Both extremities of each crossover wires are connected to an additional female single pin connector exposed at both length edges of the sheet and in close proximity to its respective width edge. Two of these additional connectors, close to a same width edge, are electrically connected to their respective closest connector. The crossover wires allow for interconnecting another device to any of the four edges of the modular device. All female connectors are maintained covered by removable insulating plugs that can be replaced by double male couplers to parallel connect two adjacent heating devices. All distances between each female connector and its respective closest sheet corner are equal to each other, in order to allow for electrical connection between two adjacent modular carpet devices.

19 Claims, 7 Drawing Sheets

MODULAR SNOW MELTING CARPET DEVICE

FIELD OF THE INVENTION

The present invention relates to a heating carpet device, more specifically to a removable electrical modular heating carpet for melting snow and ice on pathways, driveways, walkways, outdoor steps and the like.

BACKGROUND OF THE INVENTION

Many heating mat devices are being used to warm up driveways and the like to prevent the accumulation of snow or ice. These heating devices can be divided into two separate categories, the permanently installed ones and the removable ones.

The permanent heating devices, such as described in U.S. Pat. No. 3,818,892 to Von Kohorn and U.S. Pat. No. 4,564,745 to Deschenes, are typically installed underneath the pavement of the pathway at relatively high cost, thereby requiring a huge amount of energy to ensure that some heat reaches the outside surface of the pathway. This causes a large amount of heat loss. Also, they are exposed to high risk of damages due to possible soil movement.

The removable heating devices are typically laid onto the pathway surface and therefore more energy efficient. They either use electrical heating elements, such as described in U.S. Pat. No. 3,806,702 to Spencer, U.S. Pat. No. 4,814,580 to Carageorge and U.S. Pat. No. 5,591,365 to Shields, or fluid heated elements, such as described in U.S. Pat. No. 4,646,818 to Ervin, Jr., U.S. Pat. No. 5,003,157 to Hargrove and U.S. Pat. No. 5,966,502 to Pearce. The latter tends to be very complicated and expensive to manufacture even though they provide a more uniform heat distribution if connected to each other over the outdoor exposed surface.

The heating devices with electrical heating wires are much easier and fairly inexpensive to manufacture. On the other hand, they have the disadvantage of the fact that it is fairly tricky to distribute a proper amount of heat to the outdoor exposed surface by sizing the heating elements since the dissipated power is inversely proportional to the length of the heating elements. The bigger the heating mat device is, the more power is needed thus the shorter the heating wire should be, which is contradictory. This is why most of these electrical heating mats are usually available in only one or a few predetermined sizes that are not suited to fit all sizes and shapes of actual driveways, walkways and the like.

OBJECTS OF THE INVENTION

It is therefore a general object of the present invention to provide a heating carpet device of the character described that obviates the above noted disadvantages.

Another object of the present invention is to provide a heating carpet device of the character described which includes a heating element that dissipates the same amount of heat per surface area irrespectively of its overall dimensions.

Yet another object of the present invention is to provide heating carpet devices of the character described that are modular and have the property of connecting to each other without changing the resistance of the different heating elements.

A further object of the present invention is to provide a heating carpet device of the character described which can be sized in any shape as well as tailored in any length to fit and cover any geometrical surface.

A further object of the present invention is to provide a heating carpet device of the character described which further allows for adjacent connection to another heating device from anyone of its sides.

Another object of the present invention is to provide a heating carpet device of the character described that is very easy and inexpensive to manufacture.

SUMMARY OF THE INVENTION

According to one aspect, the present invention consists of a modular heating device for melting snow and ice on pathways, said device comprising:

a thick flat sheet having a length, a width, a first and a second length edges and a first and a second width edges;

two conducting wires embedded in said sheet, said conducting wires running along their respective length edge of said sheet, said conducting wires being connected at one of their extremities to a first respective connector device, said connector devices being embedded into said sheet and exposed at said first width edge of said sheet, said conducting wires further connected at their second extremity to a second respective connector device, both said second connector devices being embedded into said sheet and exposed at said second width edge of said sheet, both said second connector devices being maintained covered by removable insulating plugs, whereby said insulating plugs may be removed and further including coupler devices to replace said plugs and parallel connect two of said heating devices, all distances between each one of said connector devices and its respective closest length edge being equal to each other;

a plurality of heating elements parallel connected along said conducting wires, said heating elements being also embedded into said sheet;

a connection means adapted to mate with said first connector devices, said connection means being wire connected to an electrical power source, thereby providing power to said heating elements that uniformly dissipate heat over said sheet to melt said snow or ice present onto said heating device.

Preferably, both of said conducting wires are parallel to each other, said heating elements are adjacent and substantially parallel to each other and said sheet is of generally rectangular shape, whereby said sheet can be tailored along said length by cutting said sheet inbetween two of said heating elements.

The heating device may also have two crossover connecting wires embedded into said sheet and electrically insulated from said conducting wires and heating elements, both extremities of each of said crossover wires being connected to an additional connector device, each of said additional connector devices being embedded into said sheet and exposed at its respective length edge of said sheet and in close proximity to its respective width edge and to its respective first or second connector device, said additional connector devices located in proximity to said first width edge being connected to its close respective first connector device, all additional connector devices being maintained covered by removable insulating plugs, whereby said insulating plugs may be removed and further including coupler devices to replace said plugs and parallel connect two of said heating devices, all distances between each one of said additional connector devices and its respective close width edge being equal to said distance between each one of said connector devices and its respective close length edge; both of said connecting wires are parallel to each other, said heating elements are adjacent and substantially parallel to each other and said sheet is of generally rectangular shape, whereby said heating device being an intersection module allowing for electrical connection with an adjacent heating device from any of its width or length edges.

Preferably, each of said heating elements includes a plurality of electrical resistors parallel connected to two secondary conducting wires, each one of said secondary wires runs from its respective conducting wire of said sheet towards its opposite conducting wire without reaching the latter, each of said secondary wire being electrically connected to its respective conducting wire only.

Preferably, said first, second and additional connector devices are female single pin connectors, said coupler devices are double male single pin couplers and, said connection means are male single pin connectors, said couplers and connectors include a sealing means to protect electrical connections from humidity.

The heating device may also have a temperature control circuit series connected to said heating elements, said temperature control circuit includes a first switching means for controlling the application of said power source, said temperature control circuit further includes a temperature sensor also embedded into said sheet, said temperature control circuit closing said first switching means when the temperature read by said temperature sensor is below a preset temperature.

Preferably, said sheet further having a top surface, said heating device further including a precipitation control circuit series connected to said temperature control circuit, said precipitation control circuit includes a second switching means for controlling the application of said power source, said precipitation control circuit further includes a precipitation sensor being located onto said top surface of said sheet, said precipitation control circuit closing said second switching means when any precipitation on said top surface of said sheet is detected by said precipitation sensor.

Preferably, in a combination of a plurality of said heating devices, said heating devices are all parallel connected to each other so as to cover large surfaces of different shapes, a first and a second group of said heating devices include a temperature sensor and a precipitation sensor respectively, and further including a temperature control circuit to close said first switching means to connect said power source to said heating elements when the average temperature read by the different temperature sensors is below said preset temperature, and precipitation control circuit to close said second switching means to connect said power source to said heating elements when any precipitation on said top surface of one of said sheets is detected by its respective precipitation sensor, all said precipitation sensors being parallel connected to each other.

The heating device may also have a plurality of attachment devices located along one of said edges of said sheet to secure the latter to any adjacent sheet located therealong.

Preferably, said sheet further includes a top and a bottom surfaces, said surfaces include a plurality of parallel grooves generally running at an angle of about 45 degrees from said first width edge direction, whereby said grooves allow for water drainage towards said length edges of said sheet and improve traction thereon.

Preferably, said conducting wires and heating elements are located at generally mid-thickness of said sheet.

According to another aspect, the present invention consists of modular heating device for melting snow and ice on pathways, said device comprising:

a thick flat sheet having a length, a width, a first and a second length edges and a first and a second width edges;

a first and a second conducting wires embedded in said sheet, said conducting wires running along their respective length edge of said sheet, said first conducting wire being connected at both of its extremities to its respective first and second connector devices, said second conducting wire being connected at one of its extremities to a second respective connector device, said second connector devices being embedded into said sheet and exposed at said second width edge of said sheet;

a plurality of heating elements parallel connected along said conducting wires, said heating elements being also embedded into said sheet;

an auxiliary conducting wire embedded in said sheet and electrically insulated from said conducting wires and heating elements, said auxiliary wire running along said second conducting wire, said auxiliary wire being connected at a first extremity to its first respective connector device and at a second extremity to said second respective connector device of said second conducting wire, said first connector devices being embedded into said sheet and exposed at said first width edge of said sheet, both said second connector devices being maintained covered by removable insulating plugs, whereby said insulating plugs may be removed and further including coupler devices to replace said plugs and parallel connect two of said heating devices, all distances between each one of said connector devices and its respective closest length edge being equal to each other;

a connection means adapted to mate with said first connector devices, said connection means being wire connected to an electrical power source, thereby providing power to said heating elements that uniformly dissipate heat over said sheet to melt said snow or ice present onto said heating device.

BRIEF DESCRIPTION OF THE DRAWINGS

In the annexed drawings, like reference characters indicate like to elements throughout.

DETAILED DESCRIPTION OF THE PREFERRED EMBODIMENTS

Figure 1:
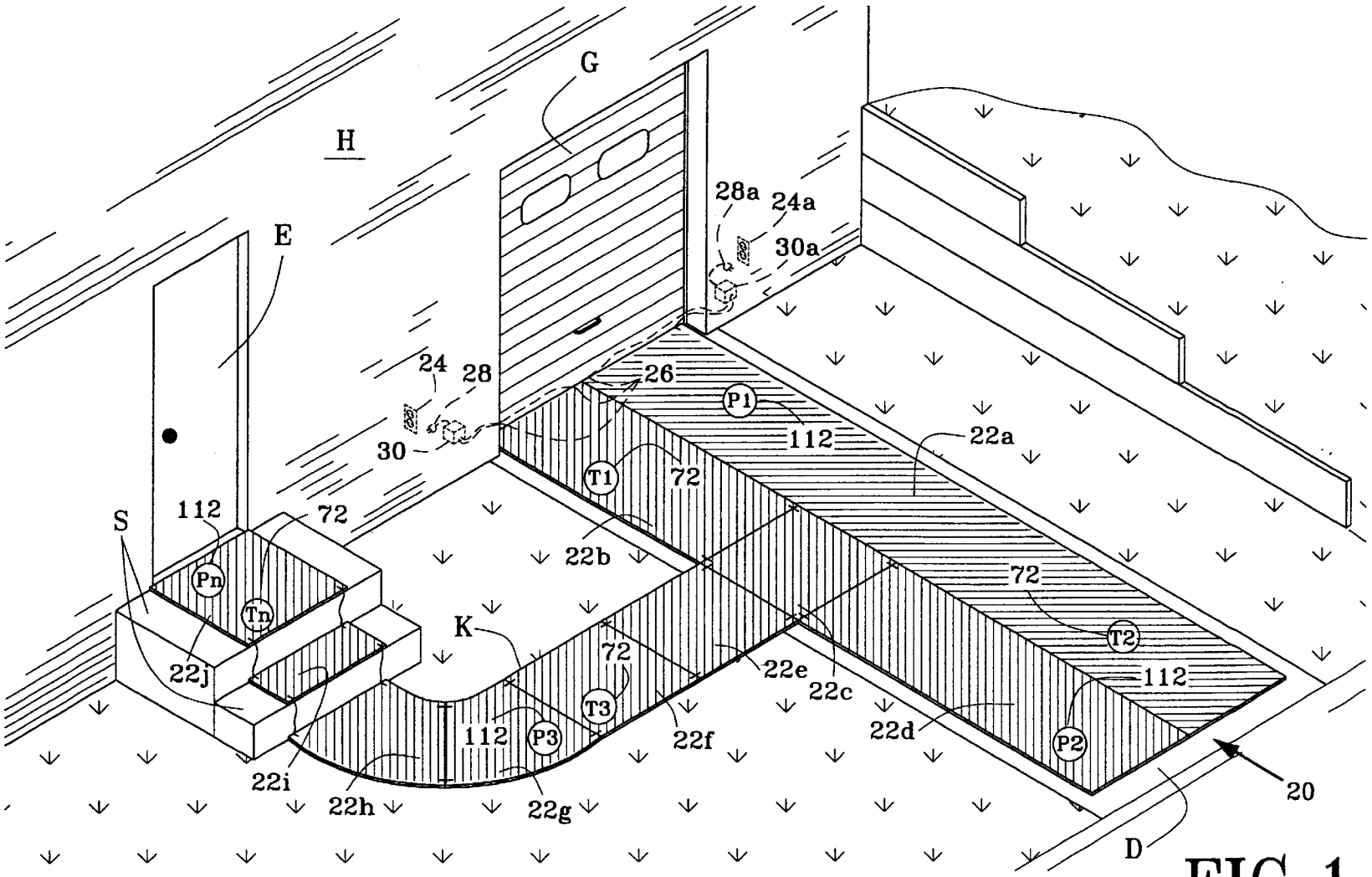
FIG. 1 is a perspective view of a plurality of different sheets of an embodiment of the modular heating carpet device of the present invention being used in a typical application.

Referring to FIGS. 1 to 9, there is shown an embodiment of the heating carpet module 20 of the present invention. As shown in FIG. 1, a plurality of heating carpet modules 20 electrically interconnected are used to cover the driveway D in front of the garage door G of a house H, the walkway K and the steps S up to the entrance door E.

Each heating carpet 20 is composed of a thin single sheet 22, such as sheets 22*a*, 22*b*, 22*c*, 22*d*, 22*e*, 22*f*, 22*g*, 22*h*, 22*i* and 22*j*, of any shape made out of a resilient electrically insulating material, such as hard molded thermoplastics and preferably hard rubber, capable of supporting heavy weights such as a standard vehicle and resistant to the outside environmental conditions including, moisture, rain, snow, salt, ultraviolet irradiation from the Sun, etc. The sheets 22 are typically of about one to two (1 to 2 cm) centimeter thick. One or more sheet 22 is connected to an electrical power source 24, preferably a 220 Volt alternating tension source, via a connection means 26 at the sheet 22 and preferably a standard power plug 28. Preferably, a ground fault interrupter 30 parallel connected to the sheet 22 is used in order to protect the heating carpet device 20 against any short or open circuit or shock hazard that might occur by accident. Also, as described below, temperature and precipitation control circuits 68, 110 are included for automatic control of application of the power source 24.

Figure 2:
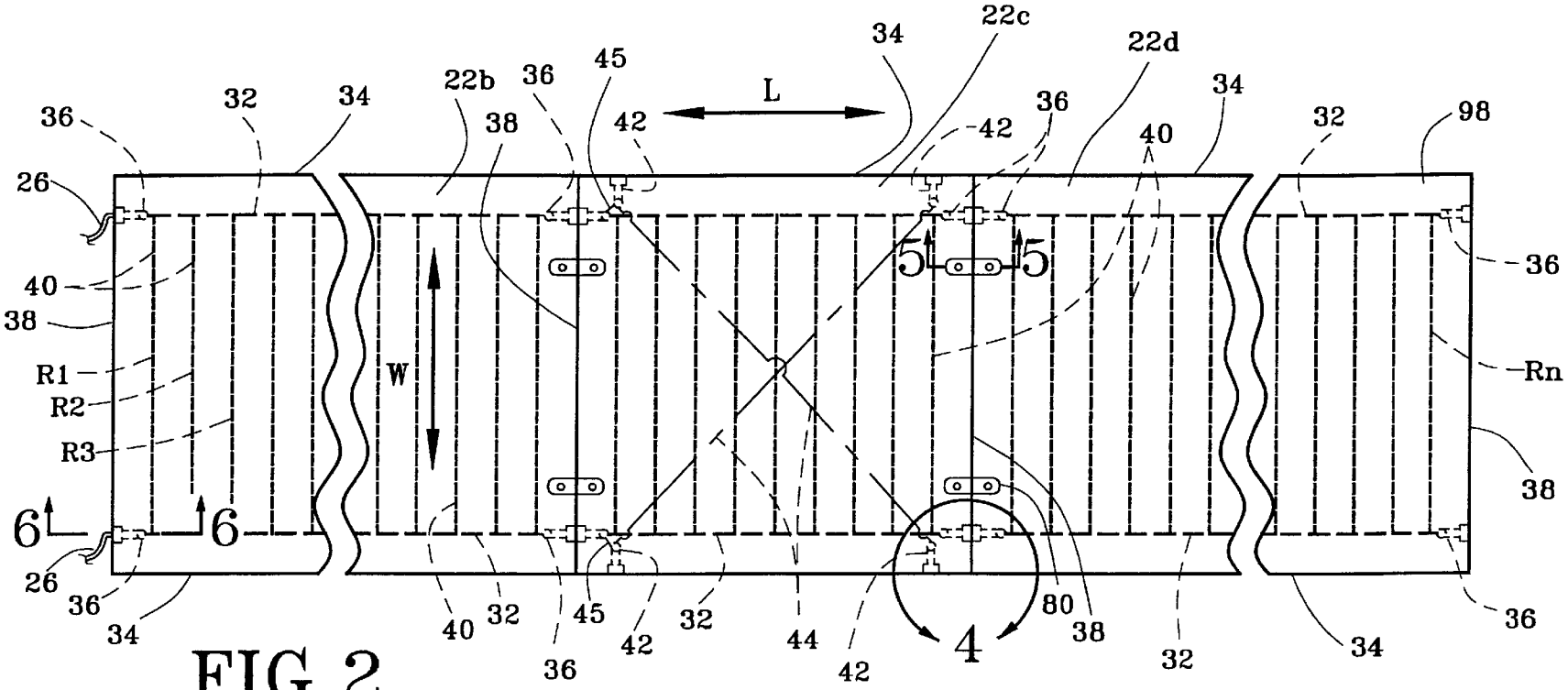
FIG. 2 is a plan view of sheets of the present invention showing the location of the heating elements embedded within the sheets and the interconnectivity between them.
Figure 3:
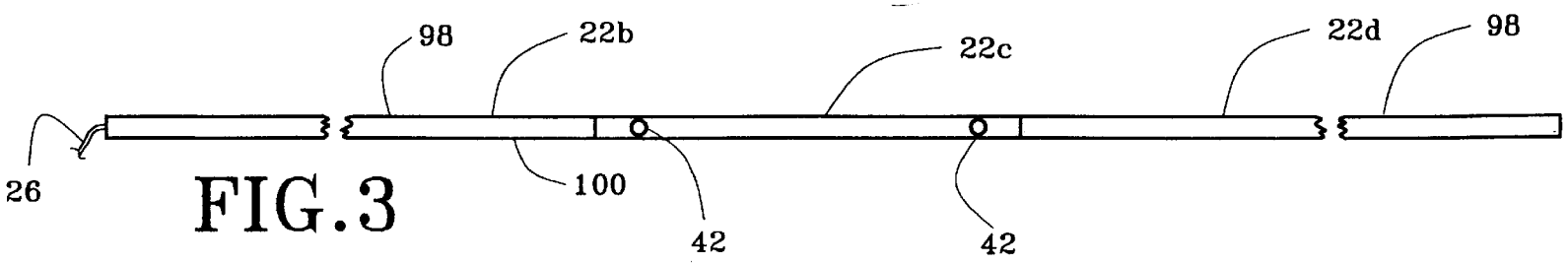
FIG. 3 is a side view of the sheets of FIG. 2.

Referring to FIGS. 2 and 3, there is shown three sheets 22*b*, 22*c*, and 22*d*, each one of the sheet 22 is defined by a length L and a width W directions. Each sheet 22 includes two conducting wires 32, schematically indicated in long dash lines, embedded into the sheet 22 and running in proximity to and along their respective length edge 34. These conducting wires 32 are of a length slightly shorter than the length L of the sheet 22 and are connected at their extremities to a connector device, preferably female single pin connectors 36 that are also embedded into the sheet 22. These female single pin connectors 36 are exposed at the width edges 38 of sheet 22.

Figure 8:
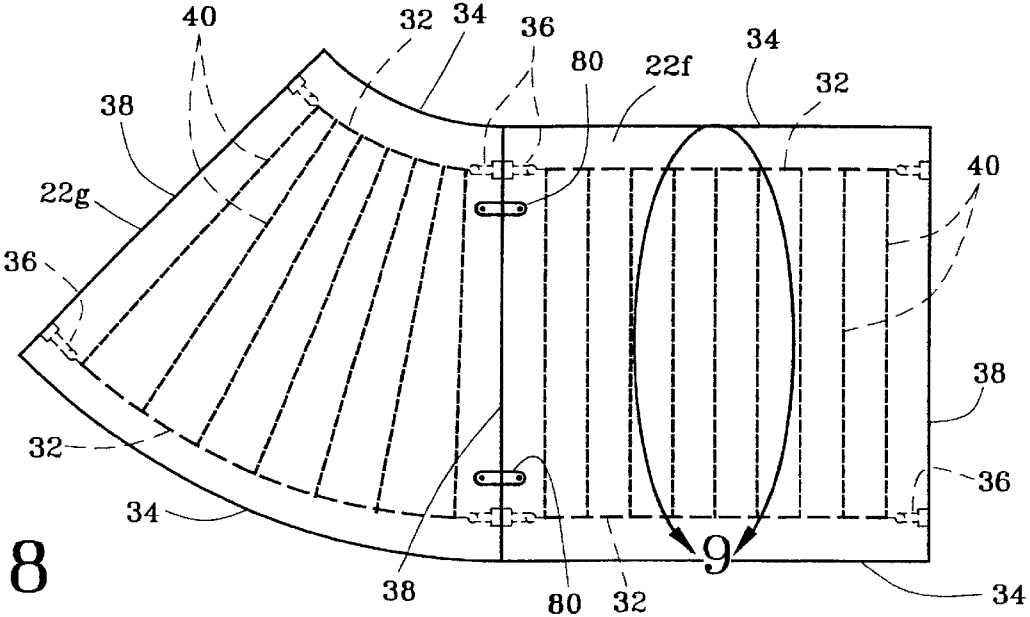
FIG. 8 is a plan view similar to FIG. 2 showing two different shapes of sheets of the present invention.
Figure 9:
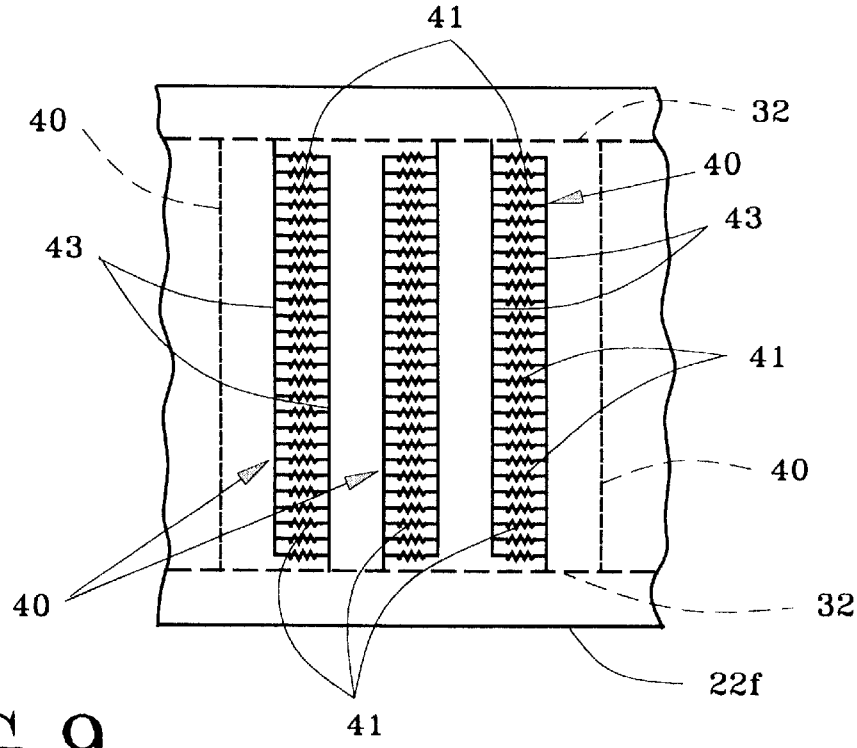
FIG. 9 is an enlarged view of line 9 of FIG. 8 showing details of heating element.

A plurality of heating elements 40, schematically indicated in short dash lines, are parallel connected along the conducting wires 32. The heating elements 40 are also embedded into the sheet 22 and generally run along the width of the sheet 22. Furthermore, the heating elements 40 are generally equally spaced apart from each other in order to uniformly distribute the heat that they are generating when connected to the power source 24 over the sheet 22. As shown in FIGS. 8 and 9, in order to adjust the uniformity of the power distribution, each heating element 40 preferably consists of an array of electrical resistors 41 of the same value all parallel connected to two secondary conducting wires 43 running from their respective conducting wire 32. Since they are parallel connected, each resistor 41 will generate the same amount of heat (half a watt for example) regardless of the length of the heating element 40, or the width W of the sheet 22. Accordingly, a smaller quantity of resistors 41 is required for a shorter length of heating element 40. Thus any length of heating element 40 is acceptable without having to modify each individual resistor 41, only the quantity will vary.

In order to eliminate short circuit problems, two adjacent secondary conducting wires 43 of two adjacent heating elements 40 are connected to the same conducting wire 32. Optionally, to help in the heat spreading, an open lattice plate (not shown) of heat conductive material is preferably embedded into the sheet 22 between the heating elements 40 and the top surface 98. The lattice plate is also preferably electrically grounded to the electrical ground of the power source 24.

The location of the heating elements 40 within the sheet 22 allows for tailoring of the sheet 22 in the direction of the length L in order to suit the size of the area to be covered by the sheet 22. When tailoring, the sheet 22 is cut inbetween and along two adjacent heating elements 40 then two blind annular holes 45 are machined around the two cut extremities of the conducting wires 32. Then, each one of the two exposed sections of the conducting wires 32 is partially cut to leave a short section 47 onto which the female single pin connector 36 will be screwed on with its metallic section 50 and installed in place. The female single pin connector 36 is sealed to the sheet 22 using appropriate glue or the like at the interface during its installation. This tailoring capability is well suited when the sheets 22 are cut out from a long roll of the sheet material with embedded conducting wires 32 and heating elements 40. Preferably, all sheets 22 have a uniform width W, approximately 120 cm, for example. Also, they are preferably provided with a few slots (not shown) located in between heating elements 40 and distributed along the length edge L for proper storage of the sheets 22 using appropriate means for hooking when the heating device 20 are not being used during summer time, for example. Generally, the slots are approximately 80 to 100 cm away from each other.

An intersection sheet module, usually of square or rectangular shape, as shown in the central sheet 22*c* of FIG. 2, includes four additional connector devices, preferably female single pin connectors 42, embedded into the sheet 22*c* and exposed on each one of both length edges 34 of the sheet 22*c*, two per edge 34. For each length edge 34, one additional connector 42 is located in close proximity to its respective width edge 38. These four additional connectors 42 are cross-connected two by two with connecting wires 44, schematically indicated with axis type of lines, also embedded into the sheet 22*c* and being electrically insulated from the conducting wires 32 and heating elements 40. Two of these four additional connectors 42, located close to the same width edge 38, are electrically connected to their closest respective female single pin connector 36, as indicated in 45, in order to provide the two different polarities of the power source 24 at each edge of the sheet 22*c*. This intersection sheet 22*c* module can be connected to any other sheet 22 from any of its four edges. Occasionally, the intersection module sheet, when of rectangular shape, can be used to reduce the width of the connected heating device sheets 22 such as to adapt for narrower walkways (see FIG. 1 in which the walkway could be narrower than illustrated), thereby causing the new width of the sheets of the narrower walkway to correspond to the length L of the intersection module sheet. In order to have different sheets 22 electrically connected to each other, all distances d between each one of said additional single pin connectors 36, 42 of all sheets 22 and its respective closest corner are equal to each other, see FIG. 4.

When a plurality of sheets 22 are used together to cover a specific surface area, they are located adjacent to each other and electrically connected using coupler devices, preferably double male single pin interconnect couplers 46, between adjacent female connectors 36. Obviously, for such interconnections to be possible, the adjacent edges of adjacent sheets 22 are required to have the same length L or width W. Preferably, these couplers 46 allow for the adjacent edges of the adjacent sheets 22 to essentially touch each other thereby eliminating any undesirable gap therebetween. All female connectors 36 or additional connectors 42 that are not used with male interconnect couplers 46, are closed with insulating side plugs 48.

Figure 4:
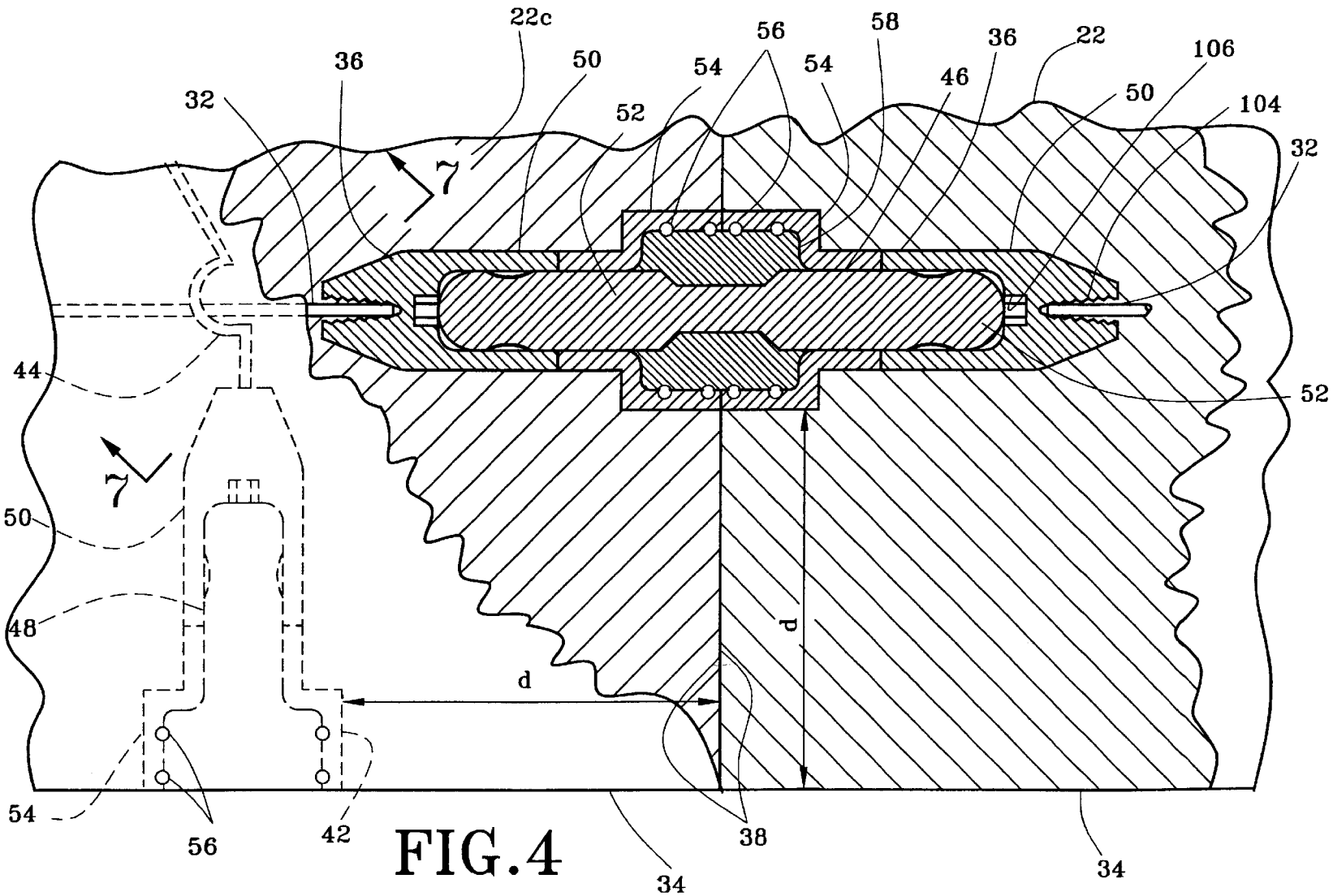
FIG. 4 is an enlarged and partially sectioned view of line 4 of FIG. 2 showing the interconnect couplers between two sheets and the attachment of the conducting wires to the female single pin connectors.
Figure 7:
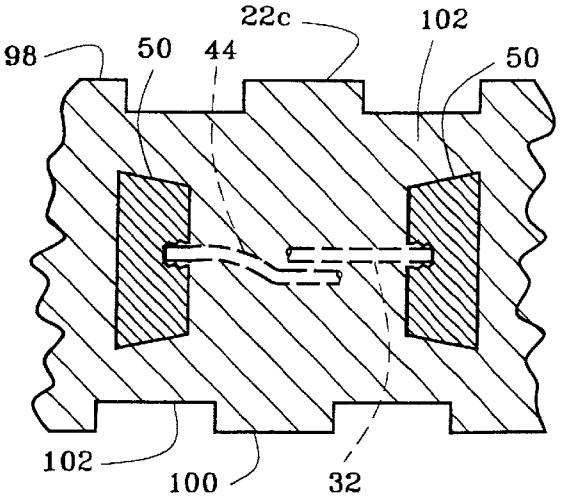
FIG. 7 is a longitudinal section taken along line 7—7 of FIG. 4 showing the insulation between the conducting wires due to their respective through thickness location.
Figure 6A:
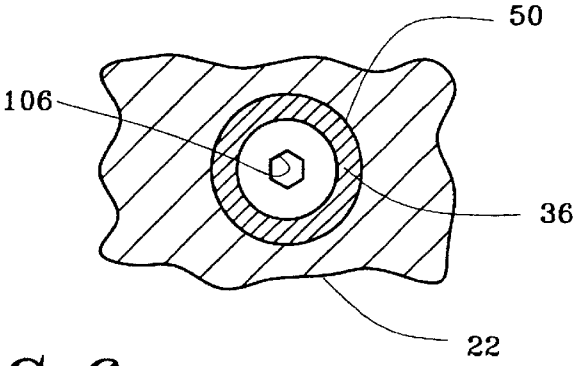
FIG. 6*a* is a partial section view taken along line 6*a*—6*a* of FIG. 6.

As shown in FIG. 4, the two adjacent connectors 36 are electrically connected using a male interconnect coupler 46. Each female connector 36 is composed of a metallic section 50 adapted to electrically connect with the metallic section 52 of the male coupler 46, and an insulating section 54 exposed to the edge of the sheet 22. In order to protect the electrical connection between the mating of the male coupler 46 to the female connector 36 against humidity or water intrusion, the insulating head 58 of the male coupler 46 includes a sealing means, preferably two successive o-rings 56, interfacing with the insulating section 54 of the connector 36. Depending if it is a female connector 36 or an additional connector 42, the metallic section 50 or 52 is also connected to its respective conducting wire 32 or connecting wire 44, the latter two being insulated from each other by the fact that they are running into two different planes within sheet 22, as shown in FIG. 7. The insulating plugs 48 have a shape similar to half of a male coupler 46 for proper mating with the female connector 36, or additional connector 42, and is entirely made out of insulating material such as thermoplastics. The insulating plugs 48 are also provided with a grasping feature (not shown) for their easy removal from the female connector 36 or additional connector 42.

Additionally, as shown in FIGS. 4, 6, 6*a* and 7, the metallic section 50 of the female connector 32 includes a conical socket type of thread 104 adapted to provide a proper electrical connection when screwed onto a conducting wire 32. The metallic section 50 also includes a screwdriver socket receptacle 106 adapted to receive a screwing tool, preferably an hexagonal key, needed to properly install the connector in place.

Figure 6:
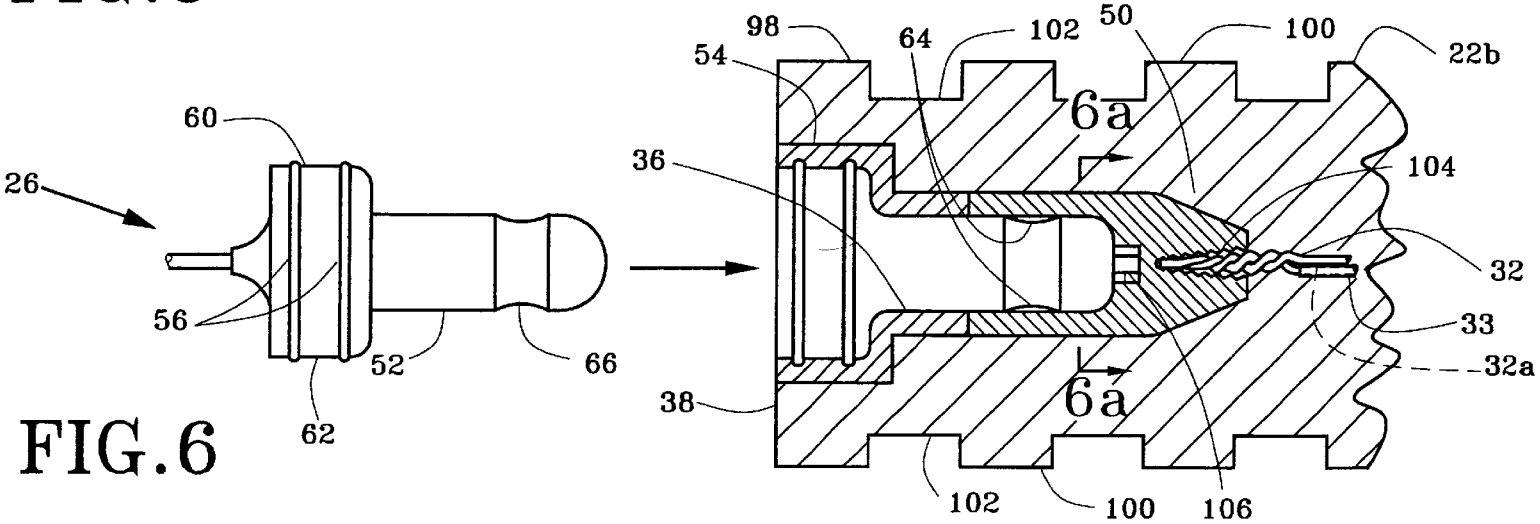
FIG. 6 is an exploded longitudinal section taken a long line 6—6 of FIG. 2 and showing the auxiliary conducting wire connected together with the conducting wire to the connector.

As shown in FIG. 6, the connection means 26, preferably a male single pin connector 60, is also similar in shape to half of a male interconnect coupler 46 having an electrical wire coming out of the male connector head 62 and internally connected to the metallic section 52 of the connector 60. This exploded view also shows that the electrical connection is ensured by typical convex spring metallic blades 64 within the metallic section 50 of the female connector 32 biased against a concave section 66 within the metallic section 52 of the male connector 60 (or any male interconnect coupler 46). Similar male connectors 60 separated by an electrical wire may be used to electrically connect adjacent sheets 22 located on steps S, as shown in FIG. 1.

Figure 5:
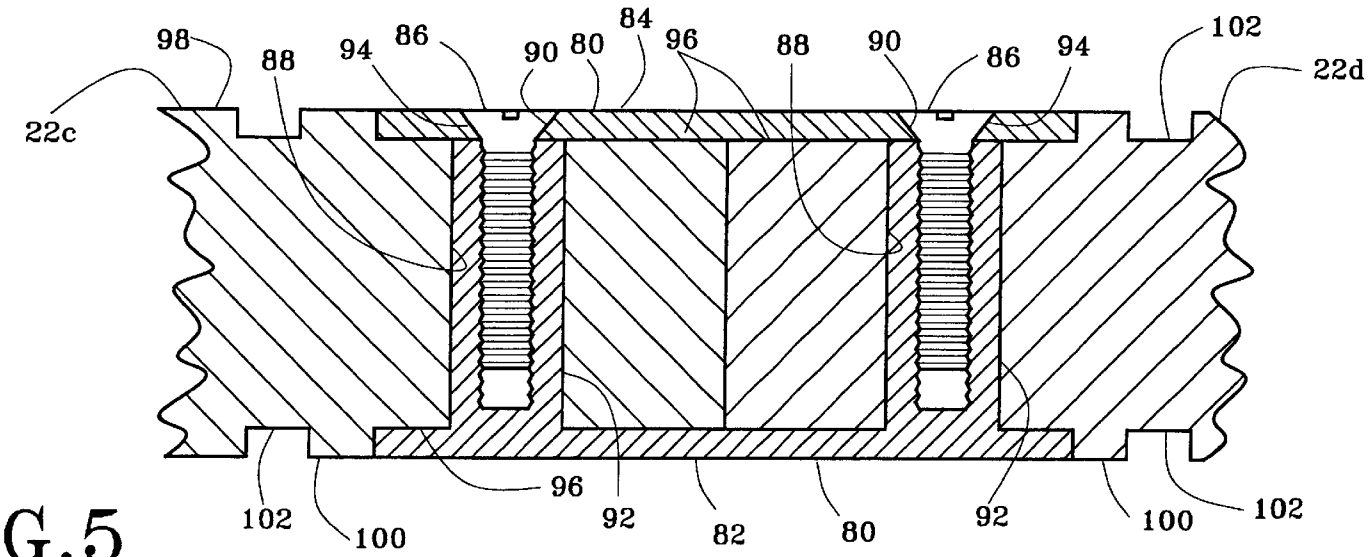
FIG. 5 is a section view taken along line 5—5 of FIG. 2 showing the attachment device between two adjacent sheets of the present invention.

In order to ensure that two adjacent sheets 22 remain secured together, a plurality of attachment devices 80, preferably two, are essentially evenly distributed along the adjacent edges. As shown in FIGS. 2 and 5, the attachment device 80 consists of a bottom 82 and a top 84 small thin rigid plates overlapping both sheets 22 at their adjacent edges and secured together using standard screws 86 located at small perforations 88 present in the sheets 22. Preferably, each screw 86 is screwed through a hole 90 made into the top plate 84, into a blind threaded hole boss 92 protruding out from the bottom plate 82. The boss 92 is sized to removably fit into the sheet perforation 88 and to abut the top plate 84. Essentially for safety reason, the top plate 84 is adapted to fully hide the head of the screw 86, preferably by having a countersink 94 at the hole 90. Furthermore, the sheets 22 may be locally adapted to receive the two plates 82, 84 into recesses 96 such that the latter two do not protrude out from the sheets 22, especially the top plate 84. The whole attachment device 80, including the screw 86, is also preferably made out of corrosion resistant type of material such as aluminum, stainless steel or plastics.

For safety, since the intent of the heating carpet 20 of the present invention is to have people to walk on them, the top surface 98 of the sheets 22 preferably presents, depending on the material it is made out of, a textured surface, in order to improve traction thereon. Also, to allow for water drainage above and underneath the sheets 22 towards the side of the driveway or walkway as opposed to directly along the slope of the same, the whole top 98 and bottom 100 surfaces of the sheets 22 are preferably provided with a plurality of generally rectangular grooves 102 running at approximately a 45 degree angle from the length L direction of the sheets 22 (see FIGS. 1, 5 to 7).

FIG. 8 shows two different sheets 22*f* and 22*g* preferably used to cover walkways K. They have the same conducting wires 32, heating elements 40 and female connectors 36 as any other sheet 22.

Figure 11:
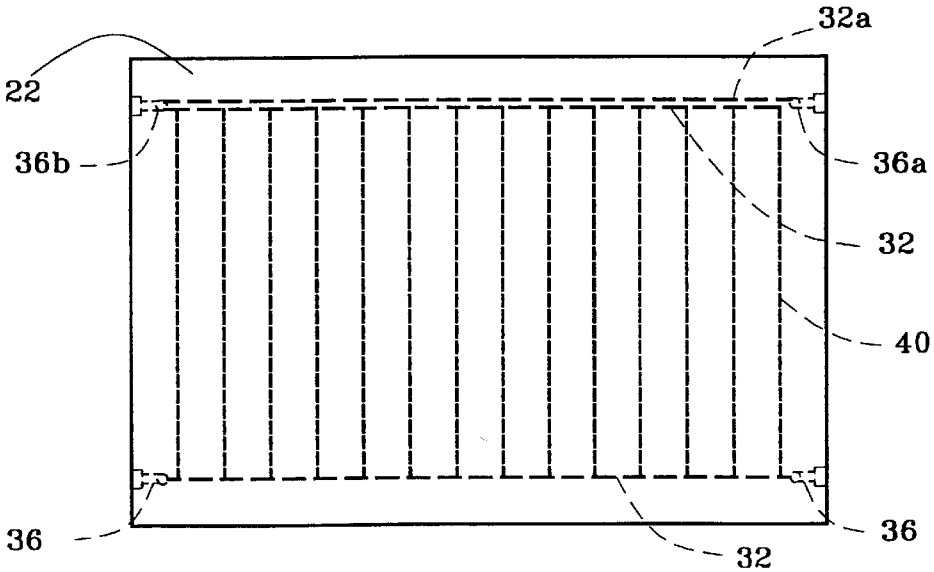
FIG. 11 is a plan view similar to FIG. 2 showing another embodiment of the sheet of the present invention with a diagonal type of connection.

Alternatively, in order to always ensure an equal electrical path length between the connectors 36 through each one of the heating elements 40, the tension source is effectively connected to diagonally opposite connectors 36. To achieve these equal electrical path lengths, one of the conducting wires 32 is not connected to the female connector 36*a* at its first extremity, where the tension source is applied, but is connected to an auxiliary conducting wire 32*a* at its second extremity via the female connector 36*b*, as shown in FIG. 11 (and FIG. 6 for the connection only). This auxiliary conducting wire 32*a* runs along and against its corresponding conducting wire 32 and is in turn connected to the female connector 36*a*. The auxiliary wire 32*a* is covered with an insulating jacket 33 in order to be electrically isolated from its corresponding conducting wire 32 and the heating elements 40.

Figure 10:
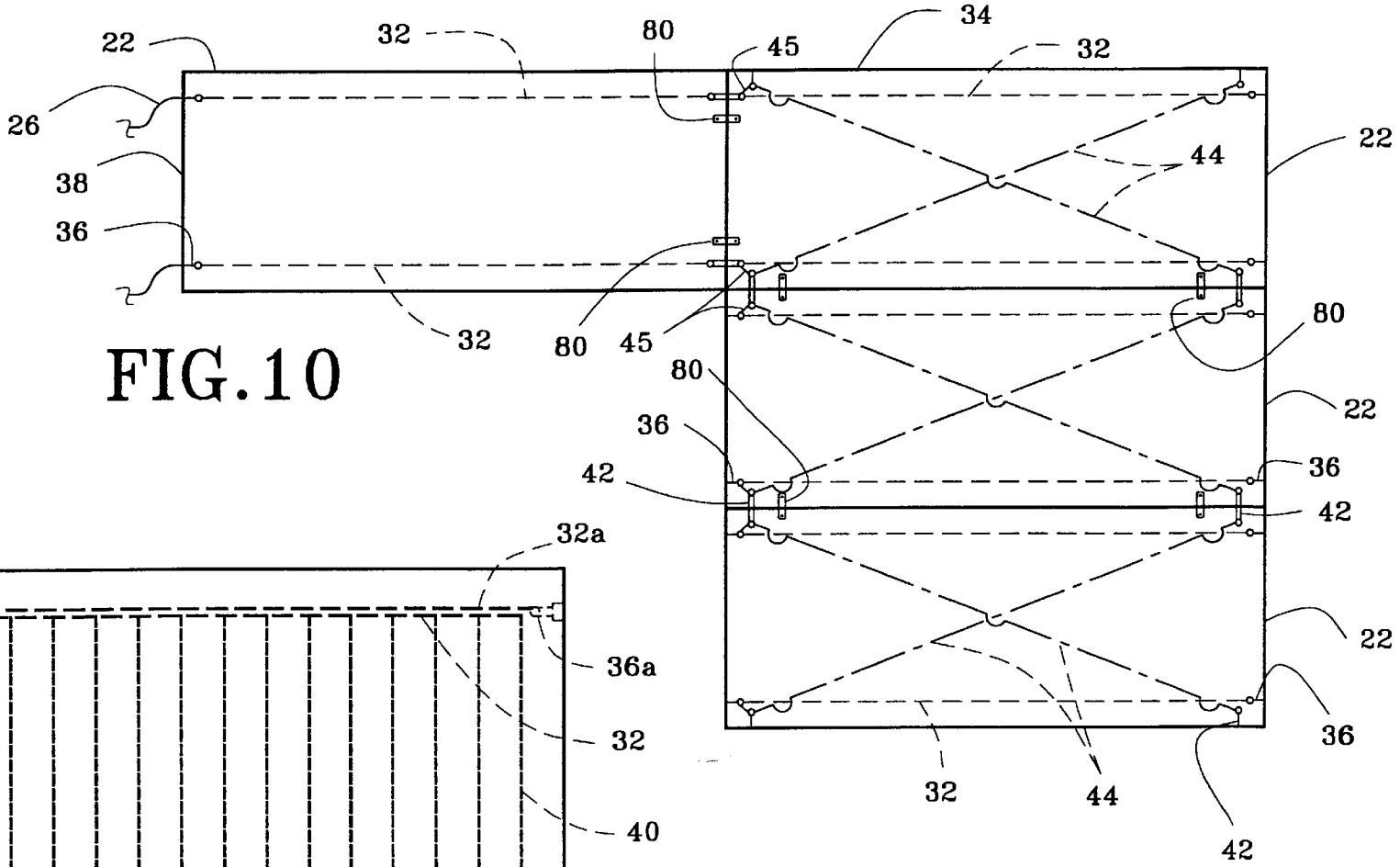
FIG. 10 is a plan view similar to FIG. 2 showing an alternative way of connecting the different sheets together.

As seen in FIG. 1, different sheets 22*b* and 22*a* may be connected to different power sources 24, 24*a* and different ground fault interrupters 30, 30*a* respectively. Alternatively, as shown in FIG. 10, sheets 22*b*, 22*c* and 22*d* could be provided with additional connectors 42 and connecting wires 44 in order to electrically connect adjacent sheet 22a along the length L direction using male couplers 46, schematically indicated with double lines, located in appropriate additional connectors 42 of the different sheets 22*b*, 22*c* and 22*d*.

Figure 12:
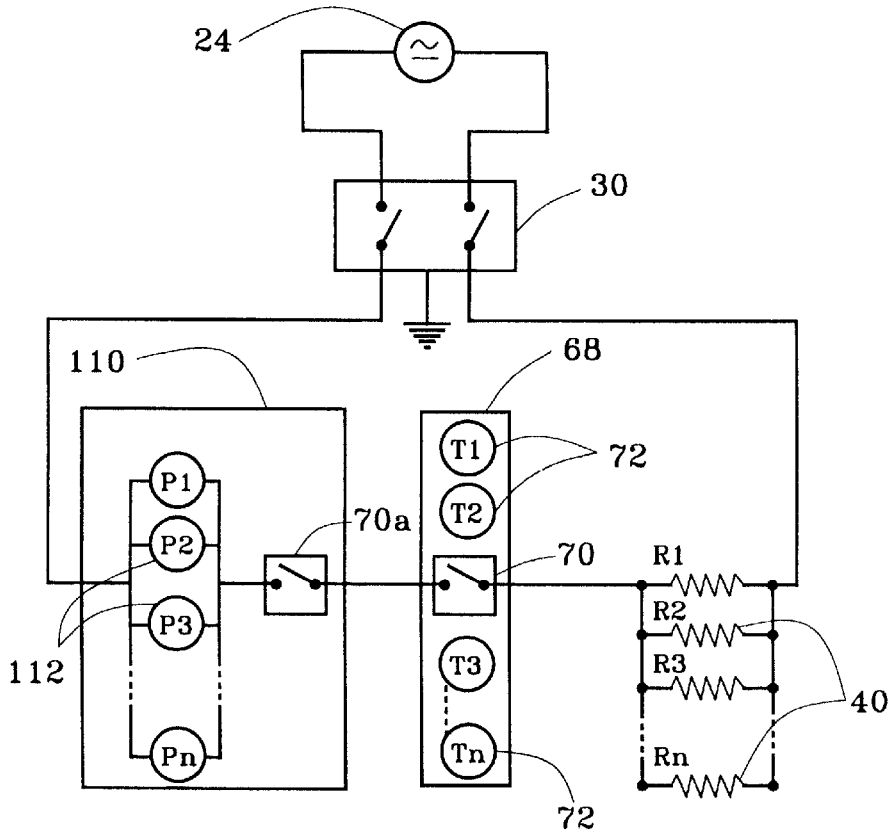
FIG. 12 is a schematic diagram showing the electrical circuit connecting the sheets of the present invention together along with a hazard safety device and temperature and precipitation control circuits.

Referring to FIG. 12, there is shown a schematic wiring diagram of the heating carpet 20 of the present invention. Each one of the heating elements 40 is represented as an electrical resistance R, indicated R1, R2, R3 to Rn, where n is the quantity of heating elements 40 of all the sheets 22, all parallel connected to each other. In order to be automatically controlled, the heating carpet system of the present invention preferably includes a temperature control circuit 68 series connected to set heating elements 40. The temperature control circuit 68 includes a switching means 70 for controlling the application of the power source 24 to the heating elements 40. The temperature control circuit 68 further includes a means for sensing the sheet surface temperature, preferably a thermistor 72, that would make the temperature control circuit 68 to close the switching means 70 when the sheet surface temperature read by the thermistor 72 is below a preset temperature. Preferably, the thermistor 72 is embedded into one of the sheets 22. In the case where the surface area covered by the different sheets 22 is large enough, more than one sheet 22 may have an embedded thermistor 72, all connected to the temperature control circuit 68. The temperature control circuit 68 would then close the switching means 70 when the average sheet surface temperature read by the different thermistors 72, indicated by T1, T2, T3 to Tn in FIGS. 1 and 12, would be below the preset temperature.

In addition, the heating carpet system of the present invention also preferably includes a precipitation control circuit 110 series connected to the temperature control circuit 68. The precipitation control circuit 110 also includes a switching means 70*a* for controlling the application of the power source 24 to the heating elements 40. The precipitation control circuit 110 further includes a means for detecting any type of precipitation on the sheet top surface 98, preferably a precipitation sensor 112, that would make the precipitation control circuit 110 to close the switching means 70*a* when precipitation is detected on sheet top surface 98. Preferably, the precipitation sensor 112 is exposed onto the top surface 98 of one of the sheets 22. In the case where the surface area covered by the different sheets 22 is large enough, more than one sheet 22 may have a precipitation sensor 112, all connected to the precipitation control circuit 110 and parallel connected to each other. The precipitation control circuit 110 would then close the switching means 70*a* when precipitation is detected by one of the different precipitation sensors 112, indicated by P1, P2, P3 to Pn in FIGS. 1 and 12. Such a precipitation control circuit 110 would prevent the heating carpet system of the present invention from drawing power from the power source 24 in a cold temperature, below the preset temperature, when the top surface 98 of the sheets 22 are dry and do not require any heating.

Accordingly, referring to FIG. 12, using such a heating carpet system (see FIG. 1), no power is applied to the heating devices 22 unless the temperature switching means 70 and the precipitation switching means 70*a* are both in close position.

Although embodiments have been described herein with some particularity and details, many modifications and variations of the preferred embodiment are possible without deviating from the scope of the present invention.

I claim:

1. A modular heating device for melting snow and ice on pathways, said device comprising:

a thick flat sheet having a length, a width, a first and a second length edges and a first and a second width edges;

two conducting wires embedded in said sheet, said conducting wires running along their respective length edge of said sheet and being substantially parallel to each other, said conducting wires being connected at one of their extremities to a first respective connector device, said connector devices being embedded into said sheet and exposed at said first width edge of said sheet, said conducting wires further connected at their second extremity to a second respective connector device, both said second connector devices being embedded into said sheet and exposed at said second width edge of said sheet; both said second connector devices being maintained covered by removable insulating plugs, whereby said insulating plugs are removed and further including coupler devices to replace said plugs and parallel connect two of said heating device, all distances between each one of said connector devices and its respective closest length edge being equal to each other;

a plurality of heating elements parallel connected along said conducting wires, said heating elements being also embedded into said sheet, said heating elements being adjacent and substantially parallel to each other and perpendicular to said length whereby said sheet can be tailored along said length by cutting said sheet inbetween two of said heating elements;

a connection means adapted to mate with said first connector devices, said connection means being wire connected to an electrical power source, thereby providing power to said heating elements that uniformly dissipate heat over said sheet to melt said snow or ice present onto said heating device.

2. A modular heating device for melting snow and ice on pathways, said device comprising:

a thick flat sheet having a length, a width, a first and a second length edges and a first and a second width edges;

two conducting wires embedded in said sheet, said conducting wires running along their respective length edge of said sheet, said conducting wires being connected at one of their extremities to a first respective connector device, said connector devices being embedded into said sheet and exposed at said first width edge of said sheet, said conducting wires further connected at their second extremity to a second respective connector device, both said second connector devices being embedded into said sheet and exposed at said second width edge of said sheet; both said second connector devices being maintained covered by removable insulating plugs, whereby said insulating plugs are removed and further including coupler devices to replace said plugs and parallel connect two of said heating device, all distances between each one of said connector devices and its respective closest length edge being equal to each other;

a plurality of heating elements parallel connected along said conducting wires, said heating elements being also embedded into said sheet;

a connection means adapted to mate with said first connector devices, said connection means being wire connected to an electrical power source, thereby providing power to said heating elements that uniformly dissipate heat over said sheet to melt said snow or ice present onto said heating device;

two crossover connecting wires embedded into said sheet and electrically insulated from said conducting wires and heating elements, both extremities of each of said crossover wires being connected to an additional connector device, each of said additional connector devices being embedded into said sheet and exposed at its respective length edge of said sheet and in close proximity to its respective width edge and to its respective first or second connector device, said additional connector devices located in proximity to said first width edge being connected to its close respective first connector device, all additional connector devices being maintained covered by removable insulating plugs, all distances between each one of said additional connector devices and its respective close width edge being equal to said distance between each one of said connector devices and its respective close length edge, both of said connecting wires are parallel to each other, said heating elements are adjacent and substantially parallel to each other and said sheet is of generally rectangular shape, whereby said heating device being an intersection module allowing for electrical connection with an adjacent heating device from any of its width or length edges.

3. A heating device as defined in claim 2, wherein each of said heating elements includes a plurality of electrical resistors parallel connected to two secondary conducting wires, each one of said secondary wires runs from its respective conducting wire of said sheet towards its opposite conducting wire without reaching the latter, each of said secondary wire being electrically connected to its respective conducting wire only.

4. A heating device as defined in claim 3, wherein said first, second and additional connector devices are female single pin connectors, said coupler devices are double male single pin couplers and, said connection means are male single pin connectors, said couplers and connectors include a sealing means to protect electrical connections from humidity.

5. A heating device as defined in claim 2, further comprising a plurality of attachment devices located along one of said edges of said sheet to secure the latter to any adjacent sheet located therealong.

6. A heating device as defined in claim 1, wherein each of said heating elements includes a plurality of electrical resistors parallel connected to two secondary conducting wires, each one of said secondary wires runs from its respective conducting wire of said sheet towards its opposite conducting wire without reaching the latter, each of said secondary wire being electrically connected to its respective conducting wire only.

7. A heating device as defined in claim 6, wherein said first and second connector devices are female single pin connectors, said coupler devices are double male single pin couplers and, said connection means are male single pin connectors, said couplers and connectors include a sealing means to protect electrical connections from humidity.

8. A heating device as defined in claim 1, further including a temperature control circuit series connected to said heating elements, said temperature control circuit includes a first switching means for controlling the application of said power source, said temperature control circuit further includes a temperature sensor also embedded into said sheet, said temperature control circuit closing said first switching means when the temperature read by said temperature sensor is below a preset temperature.

9. A heating device as defined in claim 8, wherein said sheet further having a top surface, said heating device further including a precipitation control circuit series connected to said temperature control circuit, said precipitation control circuit includes a second switching means for controlling the application of said power source, said precipitation control circuit further includes a precipitation sensor being located onto said top surface of said sheet, said precipitation control circuit closing said second switching means when any precipitation on said top surface of said sheet is detected by said precipitation sensor.

10. A heating device as defined in claim 1, further comprising a plurality of attachment devices located along one of said edges of said sheet to secure the latter to any adjacent sheet located therealong.

11. A heating device as defined in claim 1, wherein said sheet further includes a top and a bottom surfaces, said surfaces include a plurality of parallel grooves generally running at an angle of about 45 degrees from said first width edge direction, whereby said grooves allow for water drainage towards said length edges of said sheet and improve traction thereon.

12. A heating device as defined in claim 1, wherein said conducting wires and heating elements are located at generally mid-thickness of said sheet.

13. A combination of a plurality of said heating devices as defined in claim 9, wherein said heating devices are all parallel connected to each other so as to cover large surfaces of different shapes, a first and a second group of said heating devices include a temperature sensor and a precipitation sensor respectively, and further including a temperature control circuit to close said first switching means to connect said power source to said heating elements when the average temperature read by the different temperature sensors is below said preset temperature, and precipitation control circuit to close said second switching means to connect said power source to said heating elements when any precipitation on said top surface of one of said sheets is detected by its respective precipitation sensor, all said precipitation sensors being parallel connected to each other.

14. A modular heating device for melting snow and ice on pathways, said device comprising:

a thick flat sheet having a length, a width, a first and a second length edges and a first and a second width edges;

a first and a second conducting wires embedded in said sheet, said conducting wires running along their respective length edge of said sheet, said first conducting wire being connected at both of its extremities to its respective first and second connector devices, said second conducting wire being connected at one of its extremities to a second respective connector device, said second connector devices being embedded into said sheet and exposed at said second width edge of said sheet;

a plurality of heating elements parallel connected along said conducting wires, said heating elements being also embedded into said sheet;

an auxiliary conducting wire embedded in said sheet and electrically insulated from said conducting wires and heating elements, said auxiliary wire running along said second conducting wire, said auxiliary wire being connected at a first extremity to its first respective connector device and at a second extremity to said second respective connector device of said second conducting wire, said first connector devices being embedded into said sheet and exposed at said first width edge of said sheet, both said second connector devices being maintained covered by removable insulating plugs, whereby said insulating plugs are removed and further including coupler devices to replace said plugs and parallel connect two of said heating device, all distances between each one of said connector devices and its respective closest length edge being equal to each other;

a connection means adapted to mate with said first connector devices, said connection means being wire connected to an electrical power source, thereby providing power to said heating elements that uniformly dissipate heat over said sheet to melt said snow or ice present onto said heating device.

15. A heating device as defined in claim 14, wherein said auxiliary conducting wire has an insulating jacket and runs against said second conducting wire, each of said heating elements includes a plurality of electrical resistors parallel connected to two secondary conducting wires, each one of said secondary wires runs from its respective conducting wire of said sheet towards its opposite conducting wire without reaching the latter, each of said secondary wire being electrically connected to its respective conducting wire only.

16. A heating device as defined in claim 14, wherein said first and second connector devices are female single pin connectors, said coupler devices are double male single pin couplers and, said connection means are male single pin connectors, said couplers and connectors include a sealing means to protect electrical connections from humidity.

17. A heating device as defined in claim 14, further comprising a plurality of attachment devices located along one of said edges of said sheet to secure the latter to any adjacent sheet located therealong.

18. A heating device as defined in claim 14, wherein said sheet further includes a top and a bottom surfaces, said surfaces include a plurality of parallel grooves generally running at an angle of about 45 degrees from said first width edge direction, whereby said grooves allow for water drainage towards said length edges of said sheet and improve traction thereon.

19. A heating device as defined in claim 14, wherein said conducting wires and heating elements are located at generally mid-thickness of said sheet.

* * * * *